United States Patent [19]

Kirchner et al.

[11] 4,176,298

[45] * Nov. 27, 1979

[54] DISPLAY PANEL APPARATUS AND METHOD OF DRIVING

[75] Inventors: Richard K. Kirchner, Bloomington; William N. Mayer; Nicholas C. Andreadakis, both of White Bear Lake, all of Minn.

[73] Assignee: Modern Controls, Inc., Minneapolis, Minn.

[ * ] Notice: The portion of the term of this patent subsequent to Mar. 21, 1995, has been disclaimed.

[21] Appl. No.: 799,342

[22] Filed: May 23, 1977

[51] Int. Cl.[2] ..... H05B 37/00; H05B 39/00; H05B 41/00

[52] U.S. Cl. ..... 315/169.2; 340/714; 340/769; 340/805

[58] Field of Search ..... 315/169 TV; 313/484, 313/494; 340/166 R, 324 R, 324 M

[56] References Cited

U.S. PATENT DOCUMENTS

| | | | |
|---|---|---|---|
| 3,795,908 | 3/1974 | McDowell et al. | 340/324 M |
| 3,978,371 | 8/1976 | Miller | 315/169 TV |
| 4,063,231 | 12/1977 | Mayer et al. | 340/324 M |
| 4,080,597 | 3/1978 | Mayer et al. | 340/324 M |

OTHER PUBLICATIONS

Slottow, "Plasma Displays", IEEE Transactions on Electron Devices, vol. ED-23, No. 7, Jul. 1976.

*Primary Examiner*—Eugene R. LaRoche
*Assistant Examiner*—Robert E. Wise

[57] ABSTRACT

An apparatus and method for selectively voltage-energizing adjacent lines in a planar plasma display panel having a plurality of orthogonal gas-filled channels relative to said adjacent lines, and wherein a display is created by the selective gaseous ignition of regions in the channels between lines, ignition regions may be shifted reliably according to the teachings of the invention.

14 Claims, 3 Drawing Figures

DISPLAY PANEL APPARATUS AND METHOD OF DRIVING

CROSS-REFERENCE TO RELATED APPLICATIONS

The present invention is an apparatus and method which is related to apparatus of the type disclosed in U.S. application Ser. No. 706,071, now U.S. Pat. No. 4,080,597, filed July 16, 1976, and entitled "Visual Information Screen", and Ser. No. 735,153, now U.S. Pat. No. 4,063,231, filed Oct. 26, 1976, and entitled "Visual Display Apparatus", both of which are owned by the assignee of the present invention. The foregoing patent applications disclose an apparatus which is particularly adapted to the herein disclosed method, and the disclosures of said applications are incorporated herein by reference.

BACKGROUND OF THE INVENTION

In the prior art relating to the present invention there exists a considerable number of flat panel display devices which utilize the selective ignition of a gaseous medium for creating a visual display, and which are constructed of a plurality of gas cells, which are defined either physically or electrically as being regions wherein a controlled ignition may be perpetuated. An entire display screen or panel may therefore be created by the interconnection of a matrix of such gas cells wherein a display image may be created by electrically energizing combinations of electrodes protruding from the panel edges and wherein an image may be sustained on the screen by periodically electrically pulsing certain of said electrodes so as to renew cell ignitions.

The present invention is particularly adaptable to gas display panels wherein the display image is positioned on the panel by means of a time sequencing matrix of electrical signals impressed upon the panel electrodes. In this type of matrix, a set of ignition electrodes are generally wired along one edge of the panel and are adapted to receive data signals representative of the image to be displayed. The data impressed upon these electrodes is time-sequenced in combination with timing signals impressed on wires projecting along a perpendicular panel edge, which has the desired result of shifting a cell ignition region serially along a gas channel according to the timing sequence applied. Such a panel has the inherent disadvantage that a fullscreen image cannot be immediately displayed on the panel, but must be time-shifted according to the design parameters associated with the panel. On the other hand, this type of panel has the distinct advantage of minimal electronic circuitry and simplicity of design of the display panel gas cells. By using time-sequencing of the electrical lines coupling the gas channels, there is no need to provide electronic addressing capability to properly position data on the screen, but rather all that is needed is to monitor a counting mechanism to determine when the data has moved to the appropriate time-related physical position on the screen. Furthermore, since the time-shifting of data across a screen of this type can readily be accomplished at speeds far in excess of anything capable of observation by the human eye, it is an adequate approach to data display. The display unit is intended for visual observation by an operator, and under most typical operating situations the operator is unable to even detect that the data he is observing on the screen has been shifted across the screen to its apparent fixed position.

The time-sequenced voltages applied for shifting visual information in prior art devices have comprised bi-level or tri-level voltages which are used for the dual function of initially moving visual information to its proper and appropriate position on the display screen and thereafter for periodically reenergizing the selected spots to maintain the image on the screen. Frequently, prior art devices utilized a first periodic voltage sequence for sustaining the image on the screen and second and third sequenced voltage levels for initially energizing and shifting data along the screen. Since the inherent physics related to any gaseous cell demand that an ignition voltage be sufficiently high to exceed the ionization potential of the gas being ignited, and the sustaining voltage necessary to maintain ignition is a predetermined lesser value, it was frequently assumed to be necessary to provide at least two levels of driving voltage in addition to the zero or ground voltage level. These multiple voltage levels were achieved by either switching different voltage sources selectively into the system or by super-imposing an incremental firing voltage atop a predetermined sustaining voltage at appropriate times.

The specifications of the patent applications incorporated herein by reference disclose an apparatus wherein only a single voltage other than ground potential is needed for both initial cell ignition and sustaining ignition once it has been started. A unique pilot cell geometry enables the accomplishment of this result, together with the selective and sequential activation of lines adjacent one another in the panel. However, since the relative ease or difficulty with which a given cell in a gas channel may be ignited is somewhat dependent upon the history of that cell's ignition, as well as the history of ignition of adjacent cells, the voltage margins required to ensure a repeatable and reliable ignition heretofore were excessively high. These voltage margin requirements dictated the design of voltage generators which are operated above the worst-case cell voltage ignition range to insure that any cell history and electrode configuration would result in ignition. However, overdriving cells which characteristically ignite at a lower firing voltage tends to cause adjacent cells to ignite and thereby destroys the display reliability and repeatability. Consequently, display panels designed according to the teachings of the prior art must be carefully "tuned" to just the right voltage driving levels in an attempt to find an operating voltage range which is suitable for all physical and electrical cell configurations. Since this is difficult in the general case, particularly under normal manufacturing tolerance conditions, the net result is a high rate of reject panels in the manufacturing process which consequently increases the relative cost of those panels which are selected and tested to meet the permissible voltage operating margins. It would be an apparent advance in the art to discover product control techniques which would permit the voltage margins to be loosened without subsequent reduction in product reliability. Alternatively, it would be a significant advance in the art if looser voltage margins could be used in a scheme which permitted such margins by merely selecting an optimum and preferred timing cycle.

Accordingly, it is the principal object of this invention to permit the reliable and repeatable operation of a display panel, of the type disclosed in the aforementioned cross-reference and herein, solely by the sequential timing of voltage signals to be applied to the panel. It is a further object of the invention to provide such reliable and repeatable display circumstances without necessitating extremely close design control on voltage margins. This is a further object of this invention to provide such reliability and repeatable operation in the display panel without increasing the manufacturing cost of said panel.

SUMMARY OF THE INVENTION

The present invention comprises an apparatus and method of voltage-sequencing the lines in a planar display panel for optimal reliability and repeatability of the display information. The method comprises the steps of shifting a cell ignition to an adjacent cell in a "forward" direction by first igniting an adjacent cell in the "reverse" direction and then reigniting the cell and subsequently igniting the adjacent cell in the forward direction. The process is accomplished through a bi-level voltage switching and timing control mechanism, which mechanism may be applied to existing display panels by merely modifying the timing arrangement used to drive such panels.

BRIEF DESCRIPTION OF THE DRAWINGS

A preferred embodiment of the present invention is disclosed herein, and is illustrated in the appended drawings, in which.

DESCRIPTION OF THE PREFERRED EMBODIMENT

Figure 1:
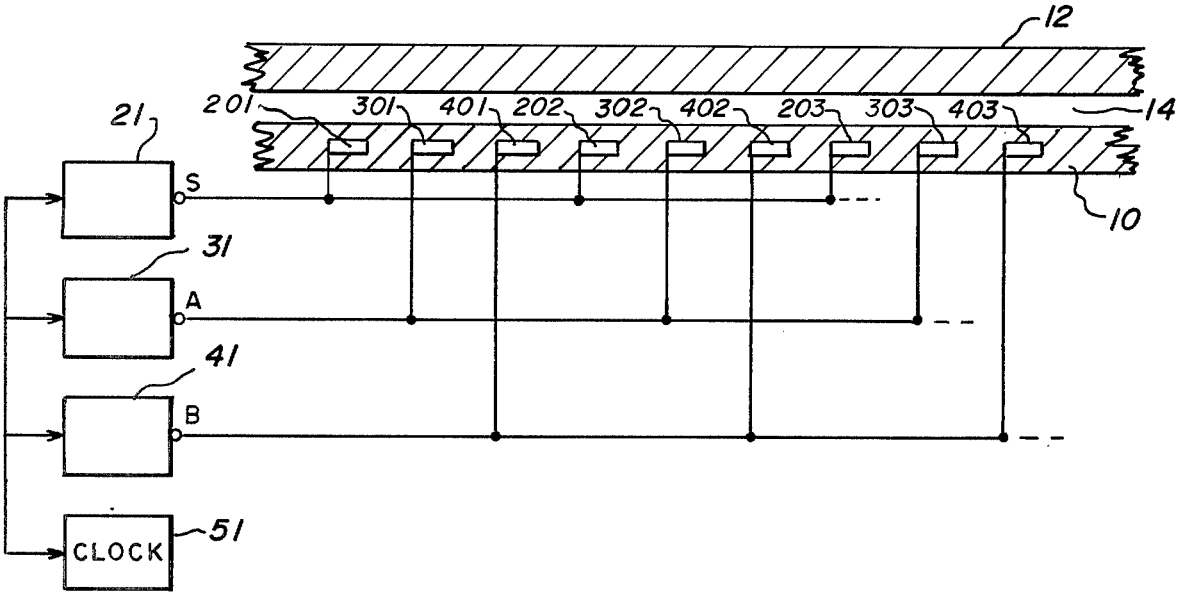
FIG. 1 illustrates a pictorial and schematic side view of a display panel section.

Referring first to FIG. 1, a pictorial illustration is shown of a display panel in cross-sectional view, and illustrating the wiring configuration to the respective signal lines embedded in lower glass plate 10. Each of the signal line extends across the lower plate area in parallel relationship, and orthogonal to a plurality of gas channels, on channel 14 being illustrated in FIG. 1. An upper glass plate 12 is sealably connected to lower glass plate 10 to contain a suitable gaseous medium such as neon in all of the gas channels. A detailed explanation of the construction of a display panel operable according to the teachings of the present invention may be found in the aforementioned patent applications. Since the present invention is concerned with the method of voltage-sequencing respective parallel conductors in plate 10, FIG. 1 illustrates the preferred electrical wiring configuration to these conductors. It may be presumed that the wiring configuration illustrated is repeated over the entire display panel area, with every third conductor respectively being denoted as an "S", "A", "B" conductor line. The invention essentially relates to the energization of these three signal lines and the interrelated gas discharge effects which are created between adjacent conductors when such energization occurs. The S signal line is shown connected to a means for developing voltage signals designated as 21. Similarly, the A and B signal lines are connected respectively to signal generating means 31 and 41. A clock 51 interconnects all signal generating means to provide a means for synchronizing the respective voltage signals and for creating the timing sequences disclosed herein. Each of the symbols 21, 31, 41, and 51 represent electronic circuit designs which are within the state of the present art, and which can be constructed by one skilled in this art, after review of the within disclosure.

The voltage signals which respectively drive the S, A and B conductors are time-sequenced bilevel voltages, preferably of signal magnitude from ground or 0 volts potential to about +200 volts (+V), in the embodiments disclosed in the herein referenced patent applications. In any particular display panel application the voltage +V will be determined by such parameters as inter-conductor spacing, glass panel dimensions, gas composition and gas channel construction, pressure, and other parameters. The respective S conductors are identified as 201, 202, . . . ; the respective A conductors are identified as 301, 302, . . . ; the respective B conductors are identified as 401, 402, . . . ; it being understood that the number of such conductor groupings is determined by the desired size of the display panel. A voltage signal applied to the S signal line will result in a simultaneous voltage energization of all S conductors 201, 202, . . . , and a voltage signal applied to the A and B conductors will similarly result in simultaneous energization of all related conductors. Gas panel illumination is caused by gaseous ignition between adjacent conductors, due to the relative voltages applied to each conductor, and to the respective electrical charges which have previously accumulated on the glass surface in gas channel 14 above the respective conductors. The accumulation of electrical charges on the glass surface is a phenomena known in the art and well-used to exploit the novel gaseous illumination characteristics for this type of device. The electric charge accumulation on the glass surface acts in a voltage-aiding or voltage-subtracting sense, depending upon the previous relative polarities of respective adjacent energized conductors. In order to achieve gaseous ignition, the sum of the voltages applied to the respective adjacent conductors and the effective voltages created by the accumulated surface charges must exceed a firing potential for the specific gas and pressure within gas channel 14. Initially there are no accumulated surface charges so the initial firing voltage must be supplied to the conductors themselves, but thereafter surface charges accumulate on the glass surfaces over at least one of the adjacent conductors to be activated, and this surface charge can be used in conjunction with a lower applied voltage to cause gas ignition. Since gaseous ignition occurs only in the region of gas channel 14 directly above and/or between adjacent conductors it is possible to control the illumination spot on the display screen. Further, since a region of ignition can be shifted to adjacent conductor pairs it is possible to move the illuminated spot across the screen by means of a series of time-sequenced voltage pulses applied to appropriate conductor combinations. In this manner data can be displayed on the display panel, moved across the panel, and erased by merely shifting the data entirely across the panel to the remote end. However, surface charges above respective conductors remain after ignition has ceased or has been shifted, and these accumulated voltage charges affect the relative ease or difficulty with which the next sequential ignition is created between any adjacent conductor pair. Accumulated surface charges tend to decay over time, thereby creating a voltage effect that is historically variable and may be detrimental to the reliable and repeatable operation of the display panel. For example, an accumulated surface charge several lines away from a conductor pair which is energized for gaseous ignition may be sufficiently high to also create gaseous ignition in the region where the surface charge has accumulated. This results in an unwanted ignition and display and degrades the character resolution of the panel. On the other hand, an accumulated surface charge in a reverse voltage sense may prevent gaseous ignition from occurring between conductors which are being activated for ignition, thereby creating a non-illuminated spot where one is desired. It is therefore extremely desirable to create a voltage-sequencing scheme which ensures that surface charge accumulation is also within controlled limits and of predetermined values so that gas cell ignition will occur only when and where it is desired.

Figure 2:
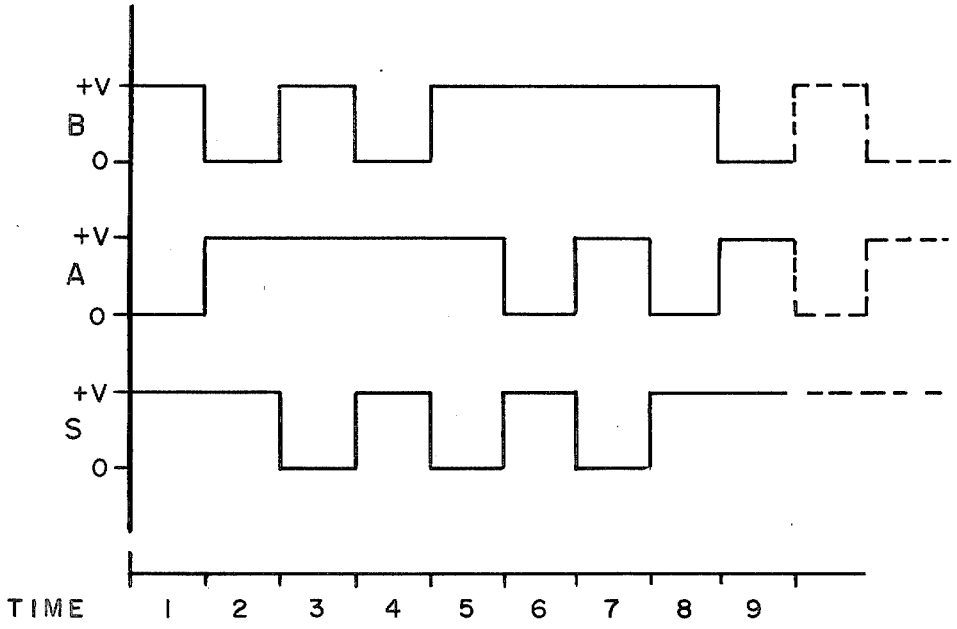
FIG. 2 shows a signal timing diagram for implementing the inventive method.

FIG. 2 illustrates a voltage timing diagram for energizing the respective S, A and B conductors according to the teachings of this invention. The voltage values are bi-level, traversing between ground or 0 volts potential and the +V value hereinbefore stated. The duration of each time increment is preferably 7 microseconds, a complete cycle therefore requiring 9 time increments or 63 microseconds. The timing sequence of FIG. 2 is activated by state of the art circuits which may be readily designed to provide the voltage signals at the times indicated. The S timing signals are simultaneously applied to all S conductors, and the A and B timing signals are similarly simultaneously applied to their respective A and B conductors. The relative timing sequence ensures that signal activation occurs to create gaseous ignition between an S - A conductor pair, an A - B conductor pair, or a B - S conductor pair during each of the timing increments. The application of these signals to the conductors illustrated in FIG. 1 provides a unique and novel shifting of the gaseous ignition from adjacent conductor pairs in the forward and reverse direction in a manner to ensure always that the next subsequent conductor pair has an accumulated surface charge of predetermined and known magnitude and polarity. Since the magnitude and polarity of the next subsequent conductor surface charge is known it is possible to safely and reliably energize appropriate conductors with a +V voltage signal without fear of losing a desired ignition point or creating a spurious ignition point elsewhere on the display panel.

The timing sequence of FIG. 2 is activated once for each step of serially shifting an ignition point across the panel. A gas "cell" on the display panel can be considered to encompass a gaseous region in a gas channel above an adjacent combination of S, A and B lines, and the next adjacent gas "cell" encompasses the next adjacent combination of S, A and B lines. Therefore, to shift a gas ignition from one gas cell to the next gas cell it is necessary to energize the timing sequence of FIG. 2 once. For each subsequent time the timing sequence is energized the gaseous ignition will progress across the panel one adjacent cell position, extinguishing in the previously occupied cell position unless a new ignition is shifted into that position.

FIG. 2 also shows, in dotted outline, the pulse signals that are generated periodically to sustain an image displayed on the panel. These signals comprise a simple reversal of voltage signals on the A and B conductors respectively, while the S conductor is held at a constant +V potential. During time intervals when new data is not being entered or shifted across the panel it is necessary to periodically apply the "sustaining" signals to preserve the ignited cells that are displayed, for the accumulated surface charge would otherwise decay to a level which would prevent reignition of a cell without reentering new data and reshifting the data back to its desired position on the screen. The preferable time period for applying these "sustaining" signals is about once every 50 micro-seconds.

Figure 3:
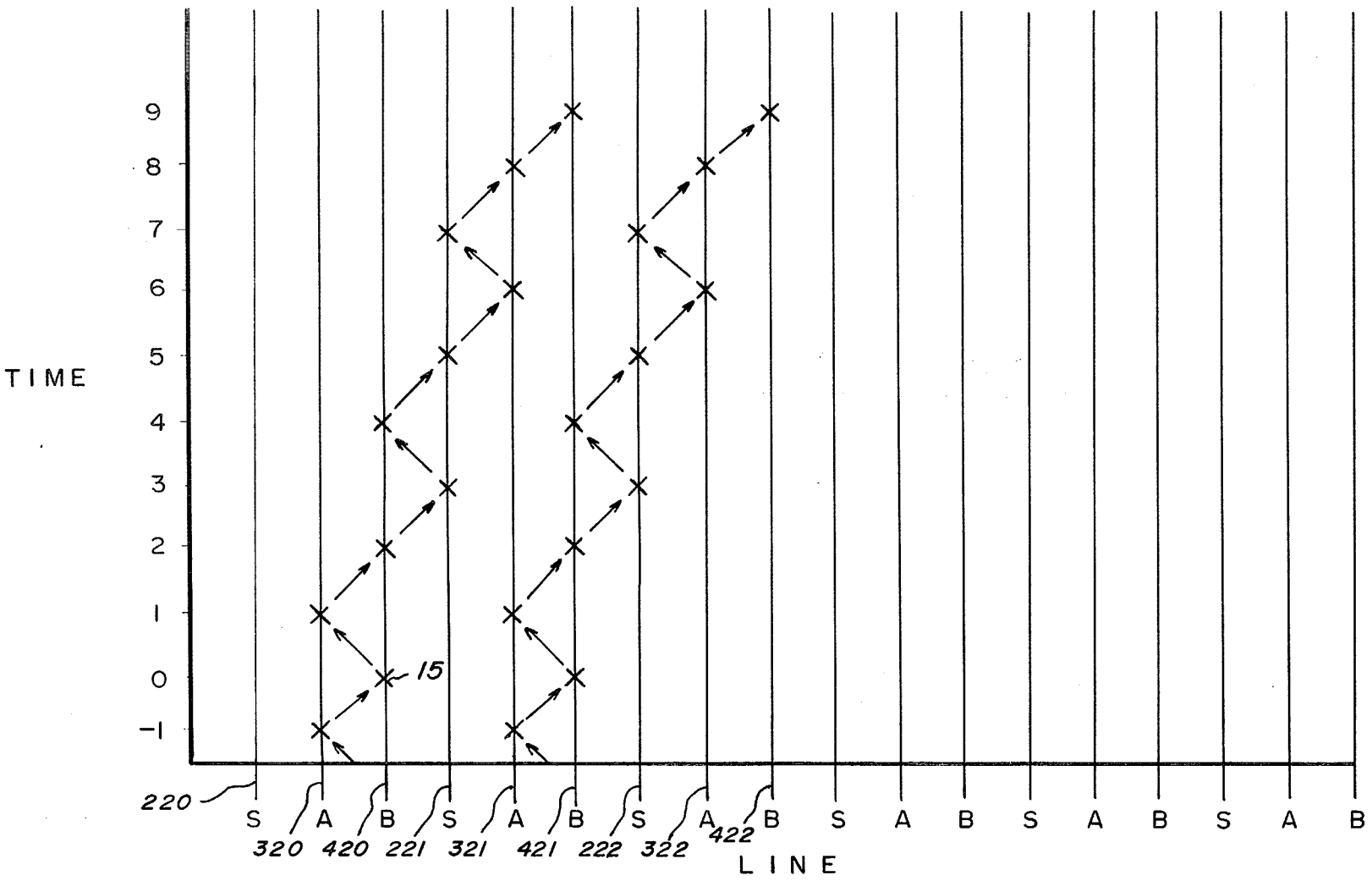
FIG. 3 diagrammatically illustrates the method.

FIG. 3 illustrates diagrammatically the operation of the method of this invention. The vertical scale of FIG. 3 is designated according to the time increments of FIG. 2, wherein each numbered time increment represents a time during which pulse signals are applied to an S, A or B conductor. The horizontal scale of FIG. 3 is representative of the adjacent conductor configuration on a panel, wherein the conductors are structured in parallel across the panel in S, A, B, S, A, B, . . . sequential arrangement. As has been hereinbefore described, each time a voltage signal is applied to an S conductor it is simultaneously applied to all other S conductors. Similarly, each time a voltage is applied to an A or B conductor it is simultaneously applied to all other respective A or B conductors. For purposes of illustration, the regions marked with an "X" represent accumulations of positive surface charges over respective conductors. For example, the "X" designated as 15 represents an accumulation of positive electrical charge over B conductor 420 at a time 0 increment. The arrows between "Xs" indicate the relative movement of the accumulated positive electrical surface charges from one time increment to the next. Thus, it can be seen that the positive electric charge accumulation which exists over B conductor 420 at time 0 moves to the glass surface over the adjacent A conductor 320 at time 1, back to the B conductor 420 at time 2 and on to the next adjacent S conductor 221 at time 3. During subsequent time intervals the accumulated positive electric surface charge moves first backward one line (420) and then forward two lines to the next adjacent A conductor 321, backward one line, and then forward two lines to the next adjacent B conductor 421. At the end of the nine time increments comprising one complete timing cycle or sequence, the accumulation of positive electric surface charge resides over a B conductor. This is always the case, so it can be assumed that at the initiation of any timing sequence any or all of the B conductors may have an accumulation of positive electrical surface charge. This accumulation of positive electrical surface charge exists when gaseous ignition has occurred recently between the B conductor and an adjacent A conductor, which would be apparent to an observer as a bright spot on the display panel.

FIG. 3 also shows the effects of applying "sustaining" signals during the time intervals preceding time 1 of the shifting timing sequence. It is to be presumed that, prior to the application of any voltage cycle, the state of the panel is such that all ignited cells are characterized by an accumulation of surface charge over a B conductor. Thus, the application of the "sustaining" signals causes the surface charge to first move to an adjacent A conductor (time −1) and then back to the B conductor (time 0). This short cycle causes any cell which had been ignited to reignite and thereby restore the full surface charge to the glass surface above the appropriate B conductor. For purposes of optimum operation of the present invention it has been found desirable to activate a short "sustaining" cycle just prior to beginning the shifting cycle disclosed herein, as this appears to improve the overall reliability of the panel display pattern.

If it is desired to move the illuminated spot from one position or "cell" to an adjacent cell the timing sequence must be initiated once. FIG. 3 illustrates this process for two such "cell" transfers. Although FIG. 3 tends to create the impression that the accumulated surface charge moves lengthwise along the lines as well as laterally, it must be remembered that the vertical scale of FIG. 3 is representative of time and does not represent a space dimension. Therefore, the accumulation of surface charge moves laterally only, and only to the extent of moving from one B conductor to the next subsequent B conductor, first passing over the intermediate S and A conductors.

The novel method of transferring voltage charge according to the teachings of this invention, and thereby shifting a gaseous discharge region from one "cell" to another, as illustrated in the timing sequence of FIG. 2 and the diagrammatic representation of FIG. 3, can be stated by the following method steps:

1. Shift the surface charge backward one line step;
2. Shift the surface charge forward two line steps;
3. Shift the surface charge backward one line step;
4. Shift the surface charge forward two line steps;
5. Shift the surface charge backward one line step; and
6. Shift the surface charge forward two line steps.

Stated more simply, the method requires that forward movement across a conductor requires first an initial rearward movement across a conductor, and then a two-step forward movement. The foregoing steps result in the overall shifting of a surface charge from a B conductor, over adjacent S and A conductors, to the next adjacent B conductor. In the preferred embodiment this represents a shift of one "cell" position, and ensures that the accumulated electrical voltage charge on the surface of the glass in the channel is always properly controlled so that the anticipated next step can be accomplished within very close +V voltage parameters. The foregoing steps may be repeated any number of times to shift an illuminated cell to any desired position on the panel, or to shift any pattern of illuminated cells to desired positions on the panel.

It is believed that this method of electrically energizing a display panel provides a completely reliable and repeatable control process over data to be presented anywhere on the panel. The invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A method of voltage-exciting a gas display panel of the type having a plurality of parallel gas channels and a further plurality of orthogonal parallel conductors separated from said channels by a dielectric medium, wherein said conductors are sequentially grouped in triplets for purposes of defining gas cell regions in said gas channels and the shifting forward along said channels of an ignited or unignited gas cell region is accomplished by predictable control of electric surface charges along said dielectric medium, comprising the steps of:

(a) shifting said electric surface charges backward one adjacent conductor position along said channel;
(b) shifting said electric surface charges forward two adjacent conductor positions along said channel; and
(c) repeating steps a) and b) two additional times.

2. The method of claim 1 wherein each step of shifting electric surface charges further comprises the voltage excitation of adjacent conductors by application of opposite voltages from a bilevel voltage source respectively to said conductors.

3. The method of claim 2, wherein the application of opposite voltages further comprises a voltage of zero volts potential and a voltage of positive voltage potential.

4. The method of claim 1, further comprising the method of sustaining an ignited gas cell region in a fixed position by application of the steps of:

(a) shifting sad electric surface charges backward one adjacent conductor position along said channel; and
(b) shifting said electric surface charges forward one adjacent conductor position along said channel.

5. In a gas display panel of the type having a plurality of parallel gas channels and a further plurality of parallel conductors orthogonally aligned with respect to said gas channels and separated therefrom by a dielectric medium, and wherein selective ignition of the gas in a region along any channel may be had by voltage excitation of adjacent conductors bounding said regions, the improvement in the method of shifting said selective ignition from one region along a channel to a desired adjacent region along said channel, comprising the steps of:

(a) voltage energizing adjacent conductors to cause said ignition region to move to a next adjacent region away from the desired ignition region;
(b) voltage energizing adjacent conductors to cause said ignition region to move to a next adjacent region toward the desired ignition region; and
(c) voltage energizing adjacent conductors to cause said ignition region to move to the desired adjacent region along said channel.

6. The method of claim 5, wherein the steps are repeated three times.

7. The method of claim 5, wherein the step of voltage energizing adjacent conductors further comprises the steps of applying a first voltage to one conductor and simultaneously applying a second voltage to the adjacent conductor.

8. The method of claim 7, wherein said first voltage is of positive potential and said second voltage is of ground potential.

9. An apparatus for connecting to a display panel of the type having a plurality of parallel gas-filled channels and a further plurality of parallel conductors orthogonally positioned relative to said channels and separated therefrom by a dielectric medium, said apparatus comprising (a) means for interconnecting every third conductor together and to a common terminal, so as to provide a first, second and third terminal respectively connected to conductors in three groups;
(b) first means for generating voltage signals and applying said signals to said first terminal;
(c) second means for generating voltage signals and applying said signals to said second terminal;
(d) third means for generating voltage signals and applying said signals to said third terminal; and (e) means for time-synchronizing said first, second and third signal generating means.

10. The apparatus of claim 9, wherein said means for time-synchronizing further comprises means for developing at least nine timing intervals.

11. The apparatus of claim 9, wherein each of said first, second and third means for generating voltage signals operates between the first and second voltage level.

12. The apparatus of claim 11, wherein said first voltage level is ground and said second voltage level is a positive potential.

13. The apparatus of claim 12 wherein only two of said first, second and third means for generating voltage signals generates the same voltage signal at any given time.

14. The apparatus of claim 11 wherein only two of said first, second and third means for generating voltage signals change at any given time.

* * * * *